United States Patent [19]

Holstein

[11] 4,204,477

[45] May 27, 1980

[54] CARRIAGE GUIDANCE SYSTEM

[75] Inventor: John H. Holstein, 5304 N. Colonial - No. 102, Fresno, Calif. 93704

[73] Assignee: John H. Holstein, Fresno, Calif.

[21] Appl. No.: 937,195

[22] Filed: Aug. 28, 1978

[51] Int. Cl.[2] ..... E01B 25/22

[52] U.S. Cl. ..... 104/106; 104/118; 198/838

[58] Field of Search ..... 104/106, 109, 118, 119, 104/245; 198/838, 845

[56] References Cited

U.S. PATENT DOCUMENTS

| | | | |
|---|---|---|---|
| 3,548,122 | 12/1970 | Hay | 104/118 |
| 3,606,839 | 9/1971 | Stafford et al. | 104/119 |
| 4,150,625 | 4/1979 | Cowan | 104/119 |

*Primary Examiner*—Joseph F. Peters, Jr.
*Assistant Examiner*—Ross Weaver

[57] ABSTRACT

A carriage guidance system is disclosed which employs an endless track defining upper and lower parallel track-ways adapted to receive guide rollers mounted on a carriage for rotation about vertical coplanar axes. The track also defines an intermediate track-way adapted to receive horizontal support rollers mounted on the carriage plate. The track-ways and carriage rollers cooperate in a manner to increase the allowable manufacturing and assembly tolerance range, and facilitate relatively easy removal of the carriage plate from the guide track.

13 Claims, 4 Drawing Figures

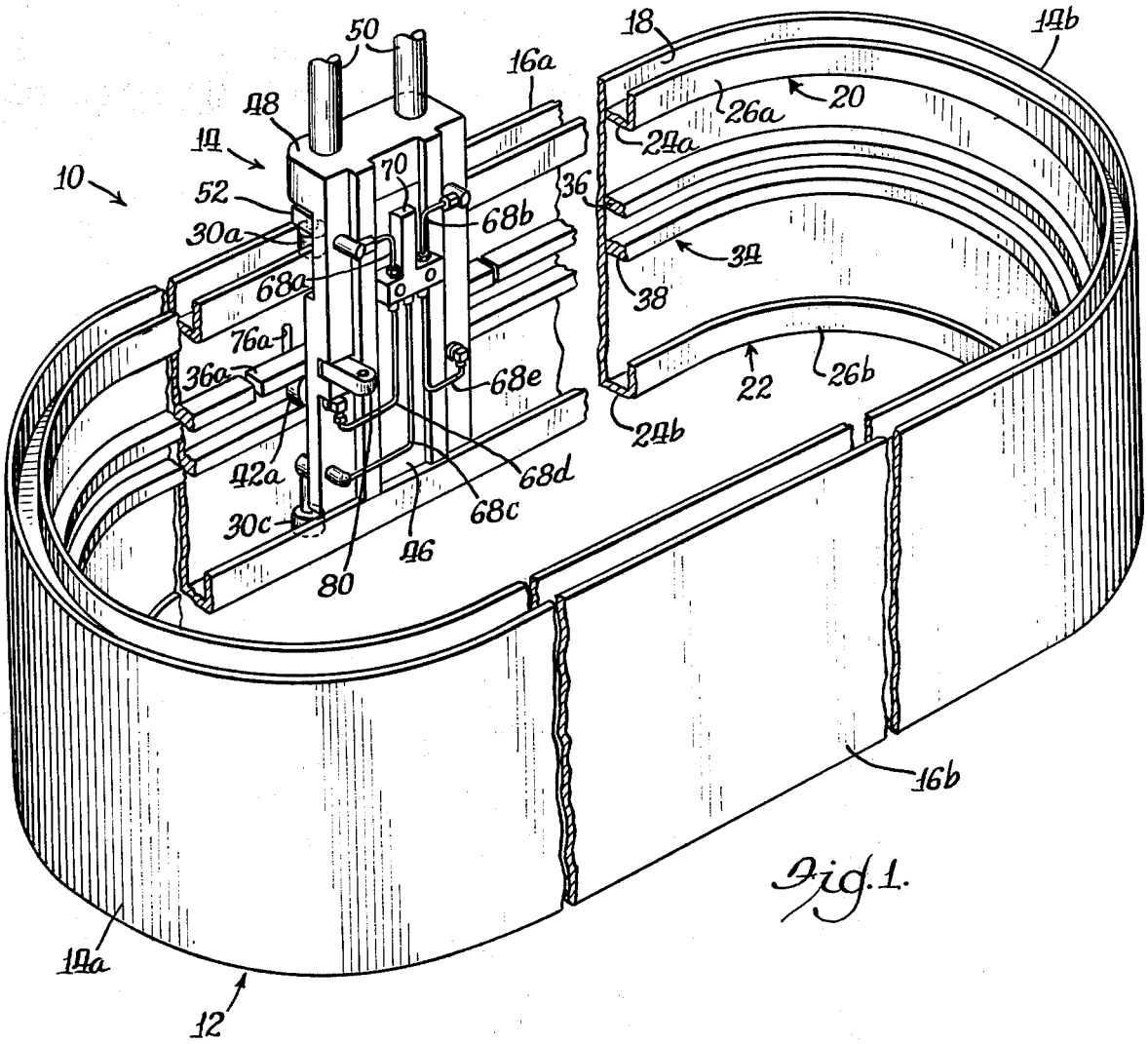
Fig. 1.
Fig. 4.
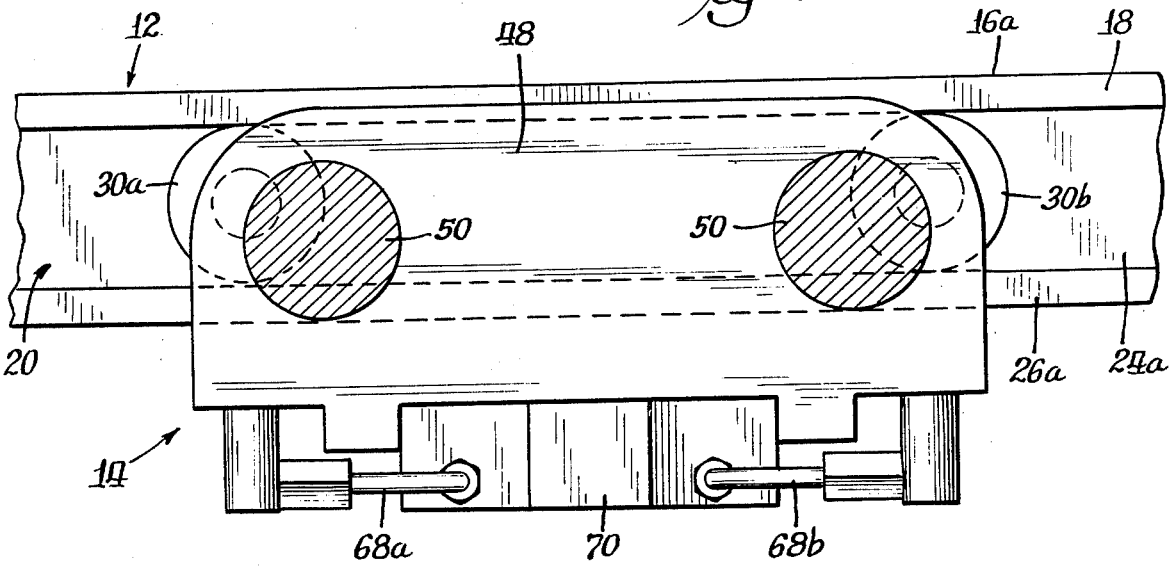

12
4
58b
56b
30b
1
76b
7
69
62b
46
70
68b
68e
68c
5
50
68a
68d
48
52
58a
56a
30a
76a
69a
62a
58c
56c
30c
16a
36a
7
26a
24a
20
18
36
3
38
22
26b
24b
3

1
26a
69a
62a
22
26b
50
20
36
38
46
48
58a
52
56a
30a
24a
12
16a
18
40
62a
40
3
58c
5
56a
30c
24b

CARRIAGE GUIDANCE SYSTEM

The present invention relates generally to carriage guidance systems, and more particularly to a novel guidance system for supporting and guiding a carriage along an endless track wherein the carriage has guide and support rollers mounted thereon for cooperation with track-ways in a manner to increase the allowable manufacturing tolerance range and enable relatively easy detachment of the carriage from the endless track.

In carriage guidance systems employing one or more support carriages movable along continuous guide tracks, it is highly desirable that the support carriages be readily detachable from the guide tracks to facilitate servicing without causing extended downtime of the system. For example, it has been proposed in the packaging industry, and particularly in applying closures to bottles and labeling the bottles, to support capper chuck or labeling devices on support carriages for movement along endless paths during which the devices are carried to apply closure caps or labels to containers brought into registration with the chucks and labelers. The capper chucks and labelers are preferably carried by individual carriages supported on an endless guide track.

In accordance with one prior system employing rotatable capper chucks to apply closure caps to containers as the capper chucks are guided along an endless path, each capper chuck is supported on a carriage plate having a plurality of vertically disposed guide rollers and a plurality of horizontally disposed support rollers received within parallel track-ways which guide the carriage during its movement through the endless path. The track-ways which receive the guide rollers are defined by an upwardly open upper track-way which receives downwardly suspended vertical guide rollers on the carriage, and a downwardly opening lower track-way which receives upwardly extending vertical guide rollers on the carriage. The horizontally disposed support rollers have cooperation with the upper track-way to provide vertical support for the carriage. A drawback to this arrangement is that the guide track has to be disassembled in order to remove the vertical guide rollers on the carriage from their respective track-ways, thereby resulting in substantial downtime of the system. Another possible shortcoming with this type system is that the upper and lower vertically disposed guide rollers generally comprise pairs of laterally spaced coplanar rollers one of which is mounted adjacent each corner of the carriage plate. In applications requiring high accuracy, obtaining the desired coplanar relation of the guide rollers is both difficult and costly.

One of the primary objects of the present invention is to provide a novel carriage guidance system which facilitates a higher manufacturing tolerance range and enables relatively easier detachment of the support carriage from an endless guide track than has heretofore been possible.

A more particular object of the present invention is to provide a novel carriage guidance system which includes endless guide track defining upper and lower track-ways adapted to receive vertically disposed coplanar guide rollers mounted on a carriage so that vertical movement of the carriage is operative to remove the guide rollers from their associated track-ways, the track means further having an intermediate track-way adapted to receive coplanar horizontal support rollers on the carriage in supporting relation therewith, the intermediate track-ways having a movable section which facilitates release of the horizontal support rollers to allow vertical movement of the carriage so as to remove the vertical guide rollers from their respective track-ways and thus enabling detachment of the carriage without significant disturbance of the guide track or other carriages as may be mounted on the guide track.

A feature of the carriage guidance system in accordance with the present invention lies in the provision of three vertically disposed guide rollers mounted on the carriage plate, two of the guide rollers being mounted in parallel laterally spaced relation generally proximate one end of the carriage plate for guiding cooperation with the upper track-way, the third guide roller being mounted on the carriage generally proximate its opposite end so as to extend in the same direction as the upper guide rollers and being axially aligned with one of the upper guide rollers and cooperable with a lower track-way so that the carriage plate may be moved within its own plane to assemble it onto and disassemble it from the upper and lower track-ways after freeing the horizontal support rollers on the carriage plate from an associated intermediate track-way.

Further objects and advantages of the present invention, together with the organization and manner of operation thereof, will become apparent from the following detailed description of the invention when taken in conjunction with the accompanying drawings wherein like reference numerals designate like elements throughout the several views, and wherein:

FIG. 1 is a foreshortened perspective view of a carriage guidance system in accordance with the present invention;

FIG. 4 is a fragmentary plan view, taken substantially along the line 4—4 of FIG. 2.

Figure 2:
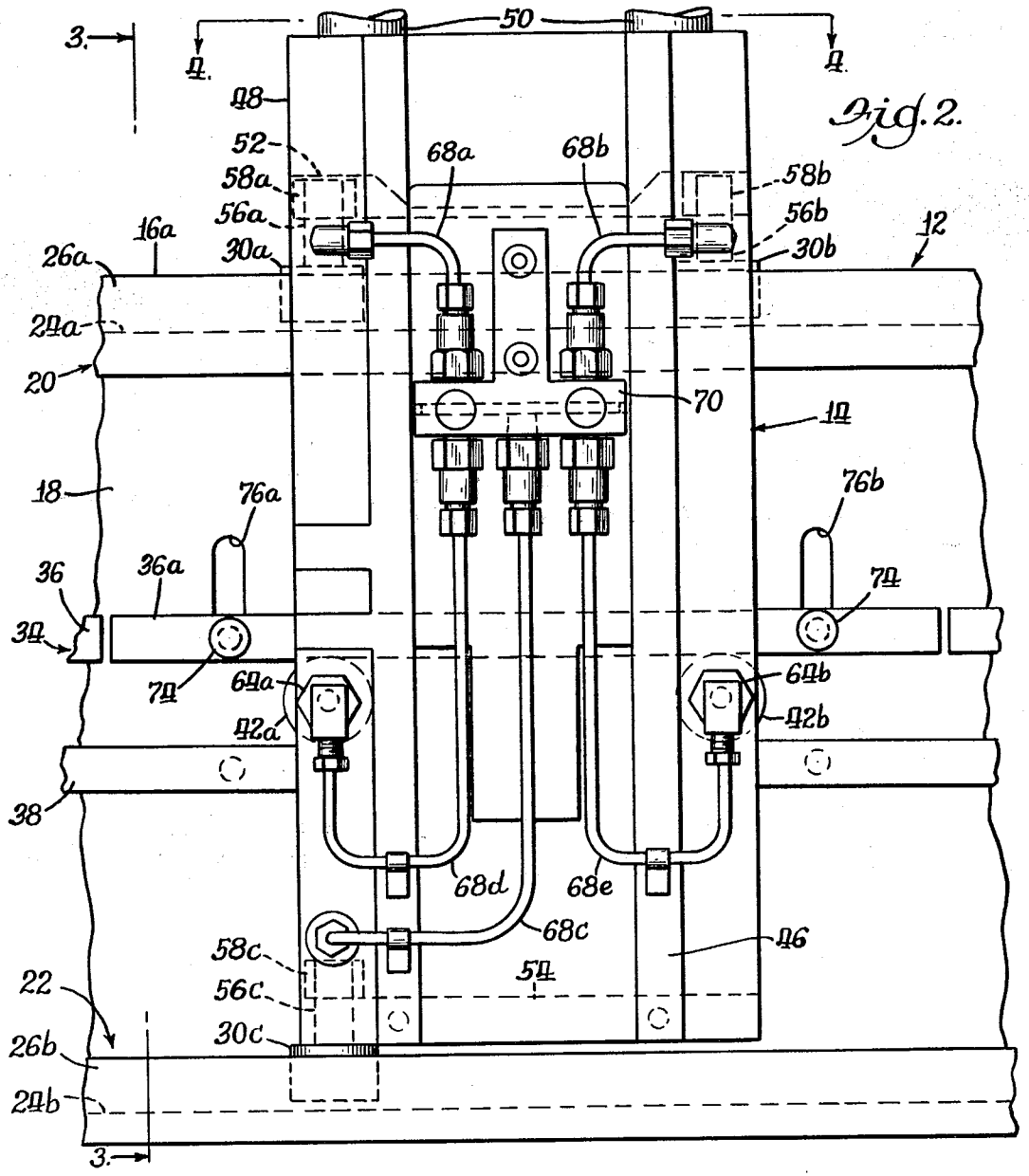
FIG. 2 is a fragmentary front elevational view, on an enlarged scale, of the carriage of FIG. 1 supported in guided relation on the endless track.

Referring now to the drawings, and in particular to FIG. 1, a carriage guidance system constructed in accordance with the present invention is indicated generally at 10. Very generally, the carriage guidance system 10, which alternatively may be termed a carriage and track system, finds particular application in systems which require movement of a carriage along an endless path or track and wherein the carriage carries a device which forms some function during its travel along the endless path. For example, in the application of closure caps to containers such as bottles, the bottles are conventionally conveyed along a predetermined path during which the containers pass a closure applying station wherein one or more capper chucks are operative to apply a closure cap to the upper end of each container. The capper chucks may be carried along an endless guide track having a portion parallel to the path of movement of the containers, and may be of the type adapted to apply pre-threaded closures to containers or the type adapted to roll from annular skirt walls of the closures against underlying conformations on the containers.

The carriage guidance system 10 illustrated in FIG. 1 may comprise a portion of such a closure applying station and includes track means in the form of an endless track 12 which, in the illustrated embodiment, has a generally oval configuration having uniformly curved track end portions 14*a* and 14*b* and intermediate straight or rectilinear track portions 16*a* and 16*b*. The endless track 12 is adapted to support carriage means in the form of one or more carriages, one of which is indicated at 14, for guided movement along the endless track.

Figure 3:
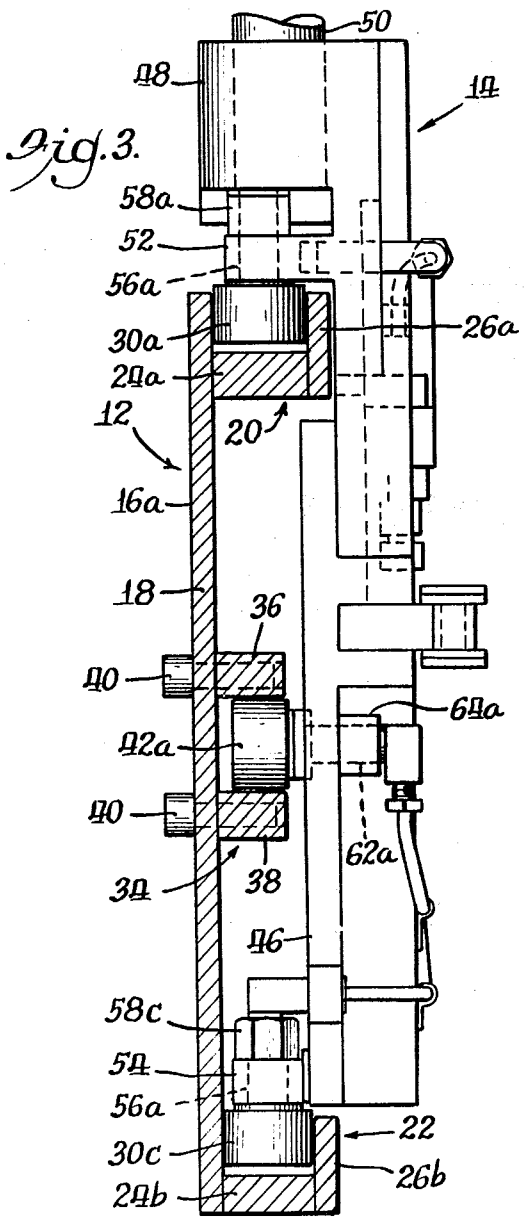
FIG. 3 is a fragmentary transverse sectional view taken substantially along the line 3—3 of FIG. 2.

Referring particularly to FIGS. 2–4, taken in conjunction with FIG. 1, the endless track 12 includes a generally oval shaped vertical support plate 18 on the inner surface of which are formed upper and lower parallel, vertically aligned, guide tracks or track-ways 20 and 22, respectively. The upper and lower track-ways 20 and 22, respectively, are defined by upwardly opening generally U-shaped channels comprises of horizontal plates 24*a* and 24*b* affixed at their outer edges to the inner surface of the support plate 18 and having vertical retaining plates 26*a* and 26*b*, respectively, secured to the inner edges of the horizontal plates. The upper and lower guide tracks 20 and 22 are adapted to receive guide rollers 30*a, b* and *c* mounted on the carriage 14 in a manner to maintain the carriage in a generally vertical plane during movement along the endless track 12.

The endless track 12 also has an intermediate track or track-way 34 which is parallel to and substantially vertically aligned with the upper and lower track-ways 20 and 22. The intermediate track 34 is defined by a pair of parallel plates 36 and 38 which, as best seen in FIG. 3, are affixed to the inner surface of the support plate 18, as by screws 40 so that the intermediate track-way is disposed approximately midway between and parallel to the upper and lower track-ways 20 and 22. The lower plate 38 extends the full inner circumference of the endless track 12 as do the horizontal plates 24*a, b* and vertical retaining plates 26*a, b* defining the upper and lower track-ways 20 and 22. The upper plate 36 also extends the full circumference of the endless track 12 except for a section or length 36*a* thereof which, as will become more apparent hereinbelow, is movable relative to the lower plate 38 to facilitate removal of the carriage 14 from the endless track 12 for maintenance or other servicing. The intermediate track-way 34 is adapted to receive a pair of support rollers 42*a* and 42*b* which are mounted on the carriage 14 for rotation about laterally spaced, parallel, substantially horizontal axes.

The carriage 14 includes a generally rectangularly shaped carriage plate 46 which has an enlarged upper end portion 48 adapted to support a device, such as a closure cap applying capper chuck (not shown), for movement about the predetermined path defined by the track-ways 22, 24 and 34. In the illustrated embodiment, a pair of parallel vertically disposed support rods 50 are mounted on the upper end 48 of the carriage plate, as by being secured within suitable bores formed in the upper end 48.

The carriage plate 46 has a pair of parallel upper and lower guide roller mounting plates or brackets 52 and 54, respectively, suitably secured thereto and extending across the full width of the carriage plate transversely of its vertical longitudinal axis, as best seen in FIGS. 2 and 3. The guide rollers 30*a* and 30*b* are mounted on the upper guide roller mounting bracket 52 through support shafts 56*a* and 56*b*, respectively, on which the guide rollers 30*a* and 30*b* are rotatably mounted. The roller support shafts 56*a, b* are secured to the mounting bracket 52 generally adjacent the opposite ends thereof so that the axes of the guide rollers 30*a, b* are parallel and vertical. Retaining nuts 58*a* and 58*b* have threaded engagement with the upper ends of the guide roller support shafts 56*a* and 56*b* to secure them on the mounting bracket 52.

The guide roller 30*c* is mounted on the lower transverse mounting bracket 54 through a support shaft 56*c* and nut 58*c* in similar fashion to mounting of the upper guide rollers 30*a* and 30*b*. As best seen in FIG. 2, the lower guide roller 30*c* is mounted on the carriage plate 46 so that its rotational axis is axially aligned with the rotational axis of the upper guide roller 30*a* and is coplanar with the axes of the upper guide rollers. By mounting the lower guide roller 30*c* on the carriage 10, in axial underlying relation to one of the laterally spaced upper guide rollers, the carriage may move freely along the endless track 12, and particularly along the curved end portions of the oval shaped track, without binding or otherwise interfering with the free movement of the carriage as could be the case if the lower vertical guide roller were mounted with its axis intermediate the axes of the upper guide rollers.

In accordance with prior practice, it was conventional to employ four vertically disposed substantially coplanar guide rollers on a carriage plate in upper and lower pairs so that each roller of the lower laterally spaced pair of rollers axially underlie a corresponding upper guide roller, such as would be effected by providing a fourth vertically disposed guide roller on the carriage plate 46 in the same horizontal planes as roller 30*c* and axially underlying the guide roller 30*b*. With four such vertical guide rollers, the requirement that the carriage plate be planar and that the four guide rollers be mounted with great precision so that their axes be coplanar was necessary in order to prevent excessive wear on the guide rollers and associated guide tracks, with the result that the precision machining requirements increased the costs of such systems. By providing three guide rollers 30*a, b* and *c* on the carriage plate 46 with the lower guide roller 30*c* generally axially aligned with one of the upper guide rollers 30*a* or 30*b*, the previously required precision manufacture to prevent binding and excessive wear of the guide rollers and associated track-ways is substantially alleviated with the result that the manufacturing tolerance range is significantly increased.

It is seen from FIG. 2 that the support rollers 42*a* and 42*b* are mounted proximate the lateral edges of the carriage plate 46 so that their horizontal axes of rotation lie in vertical planes coplanar with the axes of the guide rollers 30*a* and 30*b*, respectively. Such vertical alignment of the axes of the guide and support rollers is not critical to the present invention. The support rollers 42*a* and 42*b* are mounted on the carriage plate 46 through support shafts 62*a* and 62*b*, having retaining nuts 64*a* and 64*b* affixed thereon to maintain the support rollers in assembled relation on the carriage plate.

Preferably, means are provided on the carriage plate 46 for lubricating the vertical guide rollers 30*a, b* and *c*, and the horizontal support rollers 42*a* and 42*b*. In the illustrated embodiment, such lubricating means includes a plurality of lubricating tubes 68*a, b, c, d* and *e* which have communication with the respective bearings 30*a, b* and *c* and 42*a, b* and are connected to a manifold 70 affixed on the carriage plate 46 and providing a means for connection to a source of lubricant (not shown) facilitating application to the guide and support bearings throughout movement of the carriage 14 along the endless track 12.

In accordance with an important feature of the present invention, the guide rollers 30*a, b* and *c* are mounted so as to depend vertically downwardly from their respective mounting brackets 52 and 54 and are received within the upwardly opening track-ways 20 and 22 so that lifting of the carriage in its own plane, when the support rollers 42*a, b* are released from the track-way 34, is operative to remove the vertical guide bearings from their respective track-ways. To facilitate such lifting of the carriage and removal from the endless track 12, the aforementioned section 36*a* of the upper plate 36 defining the intermediate track 34 is mounted on the support plate 18 for upward movement relative to the underlying plate 38. To this end, the section 36*a* of the plate 36 is secured to the support plate 18 through a pair of laterally spaced support screws 74 which have threaded connection with the track section 36*a* and are received through associated elongated slots 76*a* and 76*b* in the support plate 18. In normal position, the track section 36*a* is coplanar with the remaining portion of the plate 36 so as to provide a fixed track along which the support rollers 42*a* and 42*b* travel during movement of the carriage 14 along the endless track 12. When it is desired to remove the carriage 14 from the track 12, the carriage is moved to a position wherein the support rollers 42*a, b* underlie the track section 36*a* at which time the screws 74 may be loosened to allow raising of the track section 36*a* a distance sufficient to allow lifting of the carriage plate 46 to remove the guide rollers 30*a, b* and *c* from their respective track-ways 20 and 22. Replacement or remounting of the carriage 14 onto the track 12 is effected in a reverse manner.

Movement of the carriage 14 along the endless track may be effected in substantially any known manner. In accordance with one manner of effecting movement of the carriage, a connecting bracket 80 (FIG. 1) is mounted on the carriage plate 46 and may be connected to an endless chain drive or the like (not shown) which is supported in a manner generally parallel to the endless track 12 internally thereof and to which a plurality of similar carriages 14 may be secured for effecting simultaneous coordinated movement of the carriages along the track 12 as is known.

Thus, in accordance with the present invention, a carriage guidance system is provided wherein a carriage may be guided along an endless track and is cooperative therewith in a manner to facilitate selective removal of the carriage from the track without having to effect a major disassembly of the track as has heretofore been required. By merely raising the track section 36*a*, the carriage plate 46 may be lifted vertically to remove the guide rollers 30*a, b* and *c* from their associated guide tracks which then enables removal of the carriage to a location for maintenance or other servicing. As aforementioned, by providing three guide rollers 30*a, b* and *c* generally proximate three of the four corners of the rectangular carriage plate 46, the manufacturing tolerance range for planar manufacture of the carriage plate and assembly of the vertical guide rollers in planar relation may be significantly increased, with the result that manufacturing and assembly costs are substantially reduced, in addition to providing reduced maintenance problems from track and guide roller wear as have heretofore been encountered.

Additionally, by providing only two support rollers 42*a* and 42*b* at laterally opposite edges of the carriage to take the vertical loading on the carriage, the reaction forces acting on the support rollers through the associated track plates 36*a* and 36*b* are substantially reduced over the prior art devices which, for the most part, have employed three or more horizontal support rollers on the carriage plate. This results from increasing the moment arm between the support rollers over the moment arms previously existent in carriage devices having three or more load supporting bearings thereon mounted in closer relationship to each other.

While a preferred embodiment of the present invention has been illustrated and described, it will be understood to those skilled in the art that changes and modifications may be made therein without departing from the invention in its broader aspects.

Various features of the invention are defined in the following claims.

What is claimed is:

1. A carriage guidance system comprising, in combination, track means defining an endless guide path having upper and lower parallel track-ways and an intermediate track-way parallel to said upper and lower track-ways, and carriage means including a carriage plate, three guide rollers mounted on said carriage plate for rotation about subtantially vertical axes, two of said guide rollers having parallel spaced axes and having guiding cooperation with one of said upper and lower track-ways, and the other of said three guide rollers having guiding cooperation with the other of said upper and lower track-ways, at least two support rollers mounted on said carriage plate for rotation about laterally spaced parallel horizontal axes, said support rollers being adapted for cooperation with said intermediate track-way so as to be movable therealong while vertically supporting said carriage plate, said intermediate track-way being defined by upper and lower plates normally disposed to maintain said support rollers in captured relation therebetween and having portions movable relative to each other so as to permit vertical movement of said carriage plate relative to said track means to facilitate removal of said carriage plate from said track means.

2. A carriage guidance system as defined in claim 1 wherein said other of said three guide rollers is axially aligned with one of said parallel spaced two guide rollers.

3. A carriage guidance system as defined in claim 1 wherein said upper and lower parallel track-ways are defined by upwardly opening generally U-shaped channels, said guide rollers carried by said carriage plate being supported from said carriage plate so as to extend in a vertical downward direction relative to said carriage plate and facilitating insertion within said upper and lower U-shaped channels.

4. A carriage guidance system as defined in claim 1 wherein said intermediate track-way is substantially vertically aligned with said upper and lower track-ways.

5. A carriage guidance system as defined in claim 1 wherein said upper plate of said intermediate track-way has at least one portion movable relative to said lower plate in a direction to facilitate release of said guide rollers from their said upper and lower track-ways to enable detachment of said carriage plate from said track means.

6. A carriage guidance system as defined in claim 5 wherein said track means defines an endless track having at least one rectilinear section, said relatively movable portion of said upper plate being disposed within said rectilinear section of said endless track means.

7. A carriage guidance system as defined in claim 1 wherein said carriage means includes upper and lower transverse mounting brackets secured on said carriage plate, said three guide rollers being mounted on said transverse brackets so as to extend vertically downwardly therefrom for rotation about said substantially vertical axes, said upper and lower parallel track-ways being defined by upwardly opening generally U-shaped guide channels adapted to receive said three guide rollers therein in guiding cooperation such that relative movement between said portions of said upper and lower plates defining said intermediate track facilitates removal of said carriage plate from said track means by vertically lifting said carriage plate.

8. A carriage guidance system as defined in claim 1 wherein said vertical guide rollers are mounted on said carriage so that two of said guide rollers are disposed adjacent the upper end of said carriage plate proximate each of the laterally opposite edges thereof, said other of said vertical guide rollers being disposed in axial alignment with one of said upper guide rollers.

9. A carriage guidance system as defined in claim 8 wherein said guide rollers are substantially coplanar.

10. A carriage guidance system as defined in claim 1 including lubrication means associated with each of said guide and support rollers.

11. A carriage guidance system as defined in claim 1 wherein said carriage plate has a lateral width defining lateral longitudinally extending edges, and including two support rollers mounted on said carriage plate proximate said lateral edges thereof.

12. A carriage guidance system as defined in claim 1 wherein the axes of said guide rollers are substantially coplanar.

13. A carriage guidance system as defined in claim 12 wherein said upper and lower track-ways are disposed in vertical overlying relation.

* * * * *